US006257781B1

(12) United States Patent
Harris

(10) Patent No.: US 6,257,781 B1
(45) Date of Patent: Jul. 10, 2001

(54) APPARATUS FOR TENSIONING A DRIVE BELT AND FOR ABSORBING END-OF-TRAVEL SHOCK

(75) Inventor: Richard Hunter Harris, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/406,294

(22) Filed: Sep. 24, 1999

(51) Int. Cl.[7] ..... B41J 19/30
(52) U.S. Cl. ..... 400/323; 400/285.5
(58) Field of Search ..... 400/323, 283, 400/319, 285.2, 285.5, 290, 294; 74/37

(56) References Cited

U.S. PATENT DOCUMENTS

| | | | | |
|---|---|---|---|---|
| 4,550,320 | * | 10/1985 | Biser et al. | 346/75 |
| 5,098,209 | * | 3/1992 | Gomoll et al. | 400/320 |
| 5,129,746 | * | 7/1992 | Epstein | 400/323 |
| 5,258,773 | * | 11/1993 | Arakawa et al. | 346/1.1 |
| 5,465,107 | * | 11/1995 | Mayo et al. | 346/139 R |

OTHER PUBLICATIONS

*IBM Technical Disclosure Bulletin*, vol. 34, No. 5, Oct. 1991, pp. 462–463, Home and End of Print Line Detection With a Single Sensor.

* cited by examiner

*Primary Examiner*—John S. Hilten
*Assistant Examiner*—Darius N. Cone
(74) *Attorney, Agent, or Firm*—John D. Flynn; Ronald V. Davidge

(57) ABSTRACT

A printer including two adjacent printing stations has a print head attached to a carriage moved through both printing stations, with a home position for the carriage being established between the printing stations. Data describing the position of the carriage, generated with the movement of the carriage, is reset as the carriage is moved past the home position, as indicated by a position detector. If this data is corrupted or lost, the carriage is driven in a first direction until the home position is reached or until a first end of travel position is reached, whichever occurs first. At this end of travel position, a tab extending downward from the carriage comes into contact with a tab extending upward from a sliding bracket on which an idler pulley within a belt drive system, causing movement of the carriage, is mounted. The sliding bracket then moves with the carriage, increasing tension within a belt driving the carriage, and bringing the carriage to a stop without generating substantial acoustical noise.

14 Claims, 1 Drawing Sheet

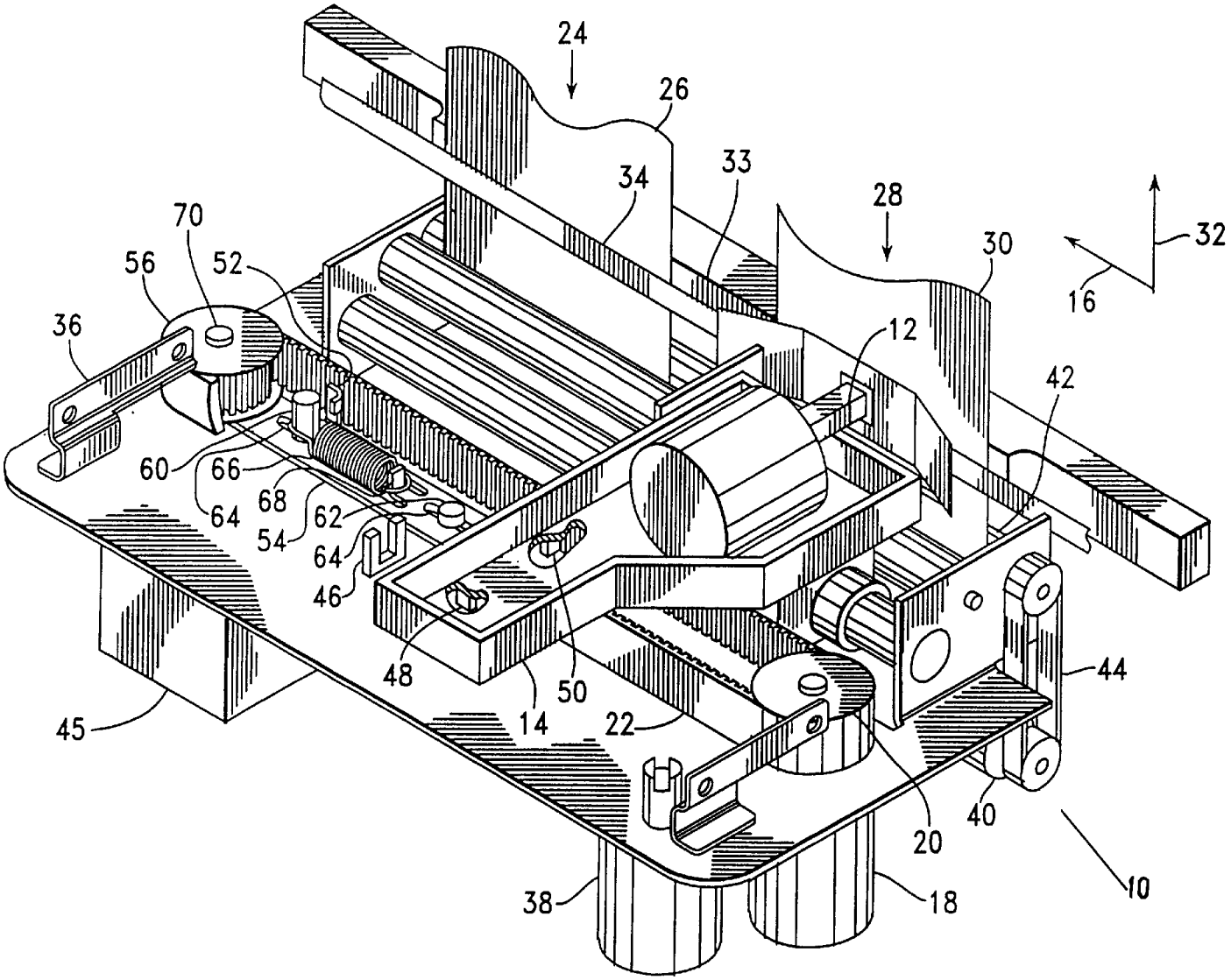
10
12
14
16
18
20
22
24
26
28
30
32
33
34
36
38
40
42
44
45
46
48
50
52
54
56
60
62
64
66
68
70

APPARATUS FOR TENSIONING A DRIVE BELT AND FOR ABSORBING END-OF-TRAVEL SHOCK

BACKGROUND OF THE INVENTION

1. Field of the Invention

This invention relates to apparatus for maintaining tension in a drive belt and for absorbing the shock occurring when a carriage driven by the drive belt is driven to an end of its travel, and, more particularly, to maintaining tension in the drive belt of a point of sale printer and to absorbing the shock of a print carriage being driven to its end of travel.

2. Description of the Related Art

Point of sale print terminals are widely used to print sales receipts, credit card receipts, and to print journal tapes including the data for a number of transactions. Such terminals are also increasingly used to print information, such as franking information on checks offered by customers for purchases.

A typical point of sale print terminal includes a wire matrix print head, which is mounted on a carriage driven horizontally, along the paper on which printing is to occur, by means of a motor driving a belt attached to the carriage. For successful printing, the printer electronics must have accurate information concerning the horizontal position of the print head. Such information is necessary to place the characters being printed in the appropriate positions on the paper and to form the individual characters themselves with a wire matrix mechanism having, for example, a single vertical line of printing wires within the print head.

In a typical point of sale print terminal, the motor used to drive the carriage is a stepper motor, and the belt drive extending between the motor and the carriage includes a toothed pulley driving a toothed belt, so that slipping does not occur between the motor and the carriage. During operation of the printer, location data providing the printer electronics with the location of the print head is derived from the electrical signal used to drive the stepper motor. After each line is printed, the print head is driven to a home position, in which a transducer provides an accurate and reliable indication that the print head has reached a particular point. This indication may be used, if necessary, to reset the location data generated using the stepper motor drive signal to a position corresponding to the home position, and to generate an error signal if the home position is not reached when it should be. The home position is typically provided at one end of the travel of the print head and carriage, so that, after every other line of printing, occurring as the print head is driven in each direction along the document being printed, the print head is driven to the home position.

Various conditions can effect the operation of this type of printer so that the data concerning the location of the print head is lost, or so that this data becomes inaccurate. These conditions include the loss of electrical power to the print terminal, manual movement of the carriage, or some obstruction is encountered. When the carriage reaches the home position, whether or not such a condition has occurred, it is stopped, with the information that it has reached this position being provided to the printer electronics. If the printer electronics determines that the data concerning the location of the print head has been lost, the print head is driven to the home position, to be stopped when the transducer indicates that this position has been reached.

Many point of sale terminals have dual print stations configured to print two separate documents extending within the printer in a spaced-apart relationship. For example, the terminal may be provided with two rolls of paper, so that sales receipts are printed on a first roll of paper for presentation to the customers, while a journal is printed on a second roll of paper for subsequent use by the store to recover sales information. This arrangement allows the sales receipts and the journal roll to have different printed information. For example, the sales receipts may include spacing to facilitate the separation of sequentially printed receipts, with information identifying the store, and even advertising messages, together with the identification of various purchases, while the journal roll has sales information printed in a much more compact form. In a high-volume store, the resulting savings in the length of the journal roll, compared to the sales receipts, is significant.

In order to minimize the time required to check out purchases, it is particularly desirable to minimize the time required to print both the sale receipts and the journal information. The rolls can be printed together, with the print head being moved across both rolls to print each line, or they may be printed sequentially, with the journal data being printed after each corresponding sales receipt. Alternately, the journal data corresponding to a number of sales transactions, for which data has been stored within a computer system, may be printed on the journal roll at a convenient time.

Because this kind of operational flexibility is important, a point of sale terminal having dual print stations should operate efficiently when printing on the two rolls together, or when printing on either roll separately. The use of a single home position at one end of the carriage motion, configured in the manner described above for a point of sale terminal having a single print station, is undesirable because, whenever the print station opposite the end of travel at which the home position is located is used, much additional time is required during the printing operation to go to the home position and to return to the print area.

One solution for this problem is to provide a home position at each end of the carriage motion, so that the adjacent home position can be used whenever only one of the print stations is being used. The disadvantage of this solution arises from the cost and complexity of the additional hardware needed, such as an additional position sensing transducer.

Another solution for this problem, which is described in the *IBM Technical Disclosure Bulletin,* Vol. 34, No. 5, October, 1991, pp. 462, 463 is to provide three flags, disposed along the drive belt to be sensed by a single position sensing transducer, with the spacing among the flags being such that a determination of the position of the print head can be made by counting the number of pulses to the stepper drive motor required to drive the print head through the distance between flags. Again, the disadvantage of this solution arises from the cost and complexity of the additional hardware needed, such as flags attached to the drive belt.

Another solution to this problem is to provide a single, central home position between the two printing fields of the printer. However, if the location data is lost, there is no way of determining the side of the central home position without moving the carriage. That is, there is no way to determine the direction to move the carriage to encounter the home position. For example, if the carriage is initially moved to the left, the home position will be encountered in the event that the carriage starts at the right of the home position, but the left end of travel of the carriage will be encountered first if the carriage starts at the left of the home position. When the end of travel position is reached in this way, the motor continues to be driven without further carriage movement. However the printer electronics drives the motor only with a maximum number of pulses, which must be sufficient to move the carriage in the left direction to the home position from wherever it is initially located on the right side of the home position. When this maximum number of pulses is exceeded, with the carriage being held against its left end of motion, the motor is driven to move the carriage to the right, until the home position is reached.

A problem with this last solution arises from the fact that a loud impact noise occurs as the carriage is moved to its end of travel position. This noise is sufficient to create a suspicion that something is wrong with the printer terminal. Thus, what is needed is a way to prevent the kind of impact causing such a noise, while allowing the carriage to be driven into its end of travel position after the carriage location data is lost.

BRIEF SUMMARY OF THE INVENTION

It is therefore a first objective of the present invention to provide a means for absorbing the shock of a driven carriage reaching its end of travel.

It is therefore a second objective of the present invention to providing a mechanism maintaining tension within a belt driving a carriage and absorbing the shock of the carriage reaching its end of travel.

It is therefore a third objective of the present invention to provide means for resetting the carriage of a printing station, after carriage position information has been lost, by driving the carriage to a home position, or to an end of travel position if the home position is not reached first, without causing a significant shock noise to be generated when the end of travel position is reached.

According to a first aspect of the present invention, there is provided apparatus for moving a carriage along a first predetermined path in a first direction and opposite to the first direction. The apparatus includes a belt driving pulley, a motor rotating the belt driving pulley, an idler pulley, a drive belt, a pulley mounting bracket, and a spring. The drive belt, which is attached to the carriage, extends partially around the belt driving pulley and the idler pulley. The pulley mounting bracket, on which the idler pulley is rotatably mounted, is mounted to move along a second predetermined path in the first direction and opposite to the first direction. The carriage, when approaching a first end of the first predetermined path moving in the first direction, contacts the pulley mounting bracket, causing the pulley mounting bracket to move along the second predetermined path in the first direction while applying additional tension to the drive belt. The spring applies a force acting in the first direction to the pulley mounting bracket.

BRIEF DESCRIPTION OF THE DRAWING

The FIGURE is a front right isometric view of a point of sale printing terminal built in accordance with the present invention

DETAILED DESCRIPTION OF THE INVENTION

Referring to the FIGURE, a point of sale printing terminal, generally indicated as 10, built in accordance with the present invention, includes a wire matrix print head 12 mounted within a carriage 14, which is in turn moved to the left, in the direction of arrow 16, and to the right, opposite the direction of arrow 16, by means of a stepper motor 18 turning a toothed belt driving pulley 20 engaging a toothed drive belt 22. This printing terminal 10 includes two printing stations, with a left printing station 24 being used to print a left document 26, and with a right printing station 28 being used to print a right document 30. Printing occurs as the print head 12 is moved across either left document 26 or a right document 30, in both the left and right directions, with the document being printed being moved upward, in a stepping motion, in the direction of arrow 32 between lines being printed. Alternately, printing may occur as the print head 12 is moved in both directions across the both the left document 26 and the right document 30, with both documents 26, 30 being moved upward together, in a stepping motion between lines being printed. Each document 24, 26 is pulled from a paper supply roll (not shown), beneath the printing terminal 10, and is fed upward between the print head 12 and a platen 33, against which the printing process occurs. An inked ribbon 34 extends between the print head 12 and both documents 26, 30, being supplied from a cartridge (not shown) within cartridge holding brackets 36. The feeding of the printing ribbon 34 results from the rotation of a ribbon feed motor 38. The ability to print the documents 26, 30 at different times is achieved through the use of a separate feed mechanism for the paper path within each of the printing stations 24, 26. Each feed mechanism includes a document feed motor 40 driving at least one drive roll 42 by means of a document drive belt 44.

The point of sale printing terminal 10 also includes electronics 45 which controls the movement of the carriage 14 by driving the stepper motor 18, with the pulse signal driving the stepper motor 18 also being used to track the movement and to generate a signal indicating the position of the carriage. As the carriage 14 is moved in either direction by the stepper motor 18, home position information is derived from the output of a position detector 46 responding to the passage therethrough of a home position tab 48, or "flag," extending downward as a part of the carriage 14. This home position information is used to reset the carriage position information to a predetermined level corresponding to the position of the carriage 14 as the position detector provides a home position signal. Preferably, the carriage is always driven to the home position with the printing of each line for this process of resetting. The position detector 46 includes a light source in one leg and a photosensitive element in the opposite leg, with a light beam from the light source and the photosensitive element being interrupted by the passage of the home position tab 48.

In a physical sense, the position detector 46 produces a home position signal at a first position as the carriage 14 is driven toward a central position from the right, in the leftward direction of arrow 16, and a home position signal at a second position as the carriage is driven toward the central position from the left, in a rightward direction opposite that of arrow 16, with the distance between these first and second positions resulting from the width of the home position tab 48. Two home positions can be defined and used in this way, with the first position, as described above, being defined as the home position to be used when the right printing station 28 is being used alone, and with the second position, as described above, being defined as the home position to be used with the left printing station 24 is being used alone. Either of these positions (first or second) may be used as a home position during simultaneous printing in both the left and right printing stations 24, 28. Alternately, a single virtual home position may be provided by driving the carriage 14 past the first or second physical home position to a central point, which is reached in the same manner traveling in either direction.

There are a number of events in which the data describing the location of the carriage 14 can be lost. For example, electrical power may be lost to the printing terminal 10, or the carriage 14 may be manually moved without a corresponding generation of pulses in the signal driving the stepper motor 18 to account for the distance moved. The occurrence of such an event may be detected directly within the printer electronics 45, such as during a power-on reset process following a loss of electrical power, or indirectly, when the output of the position detector 46 indicates that the home position has been reached before the carriage position data indicates that it should have been reached, or when the home position has not been reached when the carriage position data indicates that it should have been reached.

If the position detector 46 indicates that the home position tab 48 is in a position interrupting the transmission of light within the position detector 46, the carriage is driven, for example, to the right, until the position detector 46 indicates that the home position tab 48 has moved far enough to cease blocking this transmission of light. Next, the carriage is returned to the left, in the direction of arrow 16, until it is in the home position.

On the other hand, if the position detector 46 indicates that the home position tab 48 is not in a position interrupting the transmission of light within the position detector 46, the carriage 14 is driven in a resetting movement, for example, to the left, in the direction of arrow 16, until the position detector 46 indicates that the home position has been reached, or until, without reaching the home position, the carriage is driven with more pulses to the stepper motor 18 than the maximum number which should be used to reach the home position. With this method, the home position is reached if the carriage is initially to the right of the home position. If the carriage is initially to the left of the home position, an end-of-travel position is reached without reaching the home position.

If, during this first carriage movement, the home position is reached, the carriage may be stopped in the home position, or carriage movement may be continued, with the carriage position data having been reset according to the detection of the home position.

If, during this first carriage movement, the home position is not reached, after the stepper motor 18 has been driven with a predetermined maximum number of pulses attempting to move the carriage to the left, the carriage is moved to the right by the stepper motor 18 until the position sensor indicates that the home position tab 48 is in a position blocking transmission of light within the position detector 46. This movement of the carriage 14 to the right then continues until the position detector 46 indicates that the home position tab 48 has moved far enough to cease blocking light transmission. Next, the carriage is returned to the left, in the direction of arrow 16, until it is in the home position.

Thus, the carriage 14 is moved into an end-of-travel position whenever the home position is sought following a loss of carriage position data with the carriage 14 being left in a position to the left of the home position. In accordance with the present invention, this end-of-travel position is determined by contact between an end position tab 50 extending downward as a portion of the carriage 14 and a carriage stopping tab 52 extending upward as a portion of pulley mounting bracket 54. After contact occurs between the tabs 50, 52, the movement of the carriage 14 is coupled to movement of the pulley mounting bracket 54, with the resulting movement of the pulley mounting bracket 54 causing additional tension to be applied to the drive belt 22. The drive belt 22 easily and quietly absorbs this additional tensioning force. This drive belt 22 is preferably composed at least partly of an elastomeric material.

Thus, the present invention allows the carriage 14 to be driven into its end of travel position in the direction of arrow 16 without causing a loud impact noise. Such a noise, occurring when a carriage encounters other structures, such as frame sideplates, defining an end of travel position in the absence of the present invention, may cause operators of the printing terminal to think in error that there is something wrong with the printing terminal.

The pulley mounting bracket 54 is otherwise used to provide a tensioning force, acting on idler pulley 56, maintaining a predetermined level of tension within the drive belt 22. The pulley mounting bracket 54 is mounted to slide, on a stationary frame plate 58, in the leftward direction of arrow 16, by means of an elongated mounting pin 60 and a shortened mounting pin 62, which extend through a pair of slots 64 within the pulley mounting bracket 54. A tensioning force is applied to the pulley mounting bracket 54 by an extension spring 66 stretched between the elongated mounting pin 60 and a spring tab 68 extending upward as a portion of the pulley mounting bracket 54. The idler pulley, 56 turning with the toothed drive belt 22, is rotatably mounted on a pulley pin 70 extending upward from the pulley mounting bracket 54, so that force applied to the pulley mounting bracket 54 from the extension spring 66 is applied to the belt 22 as a tensioning force.

While the invention has been shown in its preferred version or embodiment with some degree of particularity, it is understood that this has been done only as an example, and that numerous changes, including the placement of parts, may be made without departing from the scope of the invention. For example, it is understood that the present invention may be employed in other applications using a belt moving a carriage.

I claim:

1. Apparatus for moving a carriage along a first predetermined path in a first direction and opposite to said first direction, comprising:

a belt driving pulley;

a motor rotating said belt driving pulley;

an idler pulley;

a drive belt, attached to said carriage, extending partially around said belt driving pulley and said idler pulley;

a pulley mounting bracket;

a first tab extending toward said pulley mounting bracket from said carriage, and a spring applying a force acting in said first direction to said pulley mounting bracket, wherein said idler pulley is rotatably mounted on said pulley mounting bracket, said pulley mounting bracket is mounted to move along a second predetermined path in said first direction and opposite to said first direction, said pulley mounting bracket includes a second tab extending toward said carriage to contact said first tab as said carriage approaches said first end of said predetermined path moving in said first direction, and said carriage, when approaching a first end of said first predetermined path moving in said first direction, contacts said pulley mounting bracket, causing said pulley mounting bracket to move along said second predetermined path in said first direction while applying additional tension to said drive belt.

2. Apparatus for moving a carriage along a first predetermined path in a first direction and opposite to said first direction, wherein said apparatus comprises:

a belt driving pulley;

a motor rotating said belt driving pulley;

an idler pulley;

a drive belt, attached to said carriage, extending partially around said belt driving pulley and said idler pulley;

first and second pins spaced apart in said first direction;

a pulley mounting bracket, wherein said idler pulley is rotatably mounted on said pulley mounting bracket, wherein said pulley mounting bracket is mounted to move along a second predetermined path in said first direction and opposite to said first direction, wherein said pulley mounting bracket includes a pair of slots extending around said first and second pins, wherein said pulley mounting bracket slides on said first and second pins, and wherein said carriage, when approaching a first end of said first predetermined path moving in said first direction, contacts said pulley mounting bracket, causing said pulley mounting bracket to move along said second predetermined path in said first direction while applying additional tension to said drive belt; and a spring applying a force acting in said first direction to said pulley mounting bracket.

3. The apparatus of claim 2, wherein said pulley mounting bracket includes a spring attachment section, and said spring is an extension spring extending opposite said first direction from said first pin to said spring attachment section.

4. The apparatus of claim 1, wherein said apparatus additionally includes a home position detector, providing a first signal indicating when said carriage is at a predetermined home position, carriage position calculation means operating with said motor to generate carriage position data, and error detection means providing an error indication when said carriage position data is incorrect, said carriage is driven in said first direction in a resetting movement in response to said error indication, said resetting movement is stopped in response to said first signal, or in response to a determination by said carriage position calculation means that said carriage has been moved through a predetermined maximum distance in said resetting movement, whichever occurs first.

5. Printing apparatus comprising:

a carriage movable along a first predetermined path in a first direction and opposite to said first direction;

a print head mounted on said carriage;

a drive belt attached to said carriage;

a first pulley, engaging said drive belt, having an axis of rotation;

a motor moving said drive belt to move said carriage in said first direction and opposite to said first direction; and carriage stopping means for stopping movement of said carriage at a first end of said first predetermined path by coupling movement of said carriage to movement of said axis of rotation of said first pulley engaging said drive belt, wherein said movement of said axis of rotation causes an increase in tension within said drive belt, wherein said carriage stopping means includes a pulley mounting bracket, mounted to move along a second predetermined path in said first direction and opposite to said first direction, said first pulley is rotatably mounted on said pulley mounting bracket, and said carriage, when approaching said first end of said first predetermined path moving in said first direction, contacts said pulley mounting bracket, causing said pulley mounting bracket to move along said second predetermined path in said first direction while applying additional tension to said drive belt.

6. The printing apparatus of claim 5, additionally comprising a spring applying a force in said first direction to said pulley mounting bracket to maintain tension within said drive belt.

7. Printing apparatus comprising:

a carriage movable along a first predetermined path in a first direction and opposite to said first direction;

a print head mounted on said carriage;

a drive belt attached to said carriage;

a first pulley, engaging said drive belt, having an axis of rotation;

a motor moving said drive belt to move said carriage in said first direction and opposite to said first direction; and carriage stopping means for stopping movement of said carriage at a first end of said first predetermined path by coupling movement of said carriage to movement of said axis of rotation of said first pulley engaging said drive belt, wherein said movement of said axis of rotation causes an increase in tension within said drive belt, wherein said carriage stopping means includes a pulley mounting bracket, mounted to move along a second predetermined path in said first direction and opposite to said first direction, said first pulley is rotatably mounted on said pulley mounting bracket, said carriage, when approaching said first end of said first predetermined path moving in said first direction, contacts said pulley mounting bracket, causing said pulley mounting bracket to move along said second predetermined path in said first direction while applying additional tension to said drive belt, said carriage includes a first tab extending toward said pulley mounting bracket from said carriage, and said pulley mounting bracket includes a second tab extending toward said carriage to contact said first tab as said carriage approaches said first end of said first predetermined path moving in said first direction.

8. The printing apparatus of claim 5, wherein said pulley mounting bracket is mounted to slide in said first direction and opposite to said first direction.

9. The printing apparatus of claim 5, wherein said printing apparatus additionally includes a home position detector, providing a first signal indicating when said carriage is at a predetermined home position, carriage position calculation means operating with said motor to generate carriage position data, and error detection means providing an error indication when said carriage position data is incorrect, said carriage is driven in said first direction in a resetting movement in response to said error indication, and said resetting movement is stopped in response to said first signal, or in response to a determination by said carriage position calculation means that said carriage has been moved through a predetermined maximum distance in said resetting movement, whichever occurs first.

10. The apparatus of claim 1, wherein said apparatus additionally includes a home position detector, providing a first signal indicating when said carriage is at a predetermined home position, carriage position calculation means operating with said motor to generate carriage position data, and error detection means providing an error indication when said carriage position data is incorrect, said carriage is driven in said first direction in a resetting movement in response to said error indication, said resetting movement is stopped in response to said first signal, or in response to a determination by said carriage position calculation means that said carriage has been moved through a predetermined maximum distance in said resetting movement, whichever occurs first.

11. The apparatus of claim 2, wherein said apparatus additionally includes a home position detector, providing a first signal indicating when said carriage is at a predetermined home position, carriage position calculation means operating with said motor to generate carriage position data, and error detection means providing an error indication when said carriage position data is incorrect, said carriage is driven in said first direction in a resetting movement in response to said error indication, said resetting movement is stopped in response to said first signal, or in response to a determination by said carriage position calculation means that said carriage has been moved through a predetermined maximum distance in said resetting movement, whichever occurs first.

12. The printing apparatus of claim 7, additionally comprising a spring applying a force in said first direction to said pulley mounting bracket to maintain tension within said drive belt.

13. The printing apparatus of claim 7, wherein said pulley mounting bracket is mounted to slide in said first direction and opposite to said first direction.

14. The printing apparatus of claim 7, wherein said printing apparatus additionally includes a home position detector, providing a first signal indicating when said carriage is at a predetermined home position, carriage position calculation means operating with said motor to generate carriage position data, and error detection means providing an error indication when said carriage position data is incorrect, said carriage is driven in said first direction in a resetting movement in response to said error indication, and said resetting movement is stopped in response to said first signal, or in response to a determination by said carriage position calculation means that said carriage has been moved through a predetermined maximum distance in said resetting movement, whichever occurs first.

* * * * *